US005513837A

United States Patent [19]

Osborn

[11] Patent Number: 5,513,837

[45] Date of Patent: May 7, 1996

[54] PORTABLE CLAMP

[76] Inventor: Thomas P. Osborn, 212 S. 96th Pl., Federal Way, Wash. 98003

[21] Appl. No.: 394,651

[22] Filed: Feb. 22, 1995

[51] Int. Cl.[6] ..... B25B 1/04

[52] U.S. Cl. ..... 269/127; 269/129; 269/221; 269/277; 269/279; 269/906

[58] Field of Search ..... 269/126–129, 269/266, 271, 275, 277, 279, 285, 111, 114, 246, 219, 221, 906

[56] References Cited

U.S. PATENT DOCUMENTS

| | | | |
|---|---|---|---|
| 195,429 | 9/1877 | Woodhull . | |
| 546,903 | 9/1895 | Ryan . | |
| 1,410,693 | 3/1922 | MacDonald . | |
| 1,578,898 | 3/1926 | Littleford | 269/114 |
| 2,312,165 | 2/1943 | Huebner . | |
| 2,925,109 | 2/1960 | Walker | 269/285 |
| 3,052,461 | 9/1962 | Bateman | 269/275 |
| 3,726,466 | 4/1973 | Vedder et al. . | |
| 4,427,191 | 1/1984 | Hess | 269/128 |
| 4,781,787 | 11/1988 | Weissfloch et al. | 269/127 |
| 4,824,066 | 4/1989 | Smith . | |
| 4,978,100 | 12/1990 | Peurifoy . | |
| 5,024,428 | 6/1991 | Ramsay | 269/275 |

*Primary Examiner*—Robert C. Watson
*Attorney, Agent, or Firm*—Roy E. Mattern, Jr.

[57] ABSTRACT

The portable clamp is used, for example, in making repairs to a product, such as a snowboard. The repair volume location of the snowboard is reworked to prepare this repair volume, i.e. a damaged portion of the product, to receive repairing materials. After their placement, a pressure distribution plate of this portable clamp is positioned over, and generally beyond, the repair volume location. Then a bottom clamp bar and a top clamp bar are positioned, respectively, under and over the snowboard. These clamp bars are thereafter drawn together by using the preliminary clamping fastener assemblies located at their respective ends. Then final clamping fastener assemblies, threadably positioned in the top clamp bar, in the central portion thereof, are tightened to continue the distribution of clamping forces to the pressure distribution plate. These final clamping forces, transmitted through the pressure distribution plate, conform the curing repairing materials to match the overall contour of the product being repaired.

12 Claims, 3 Drawing Sheets

PORTABLE CLAMP

BACKGROUND

Products, such as snow skis, and now such as snowboards, sometimes during their useful life need repairing. They must be held, preferably in a convenient position. Then, when in this repair position, sometimes a clamping force must be applied and held during the curing time of repairing materials, utilized in the repair volume location of the product.

In 1943, James G. Huebner in his U.S. Pat. No. 2,312,165 illustrated and described his ski bench to which a snow ski could be positioned and held in place, in either an upright, or upside down position thereof. A clamp to be subsequently used in making a repair at a repair volume location was not shown.

However, clamps, and their components thereof, are available to crafts persons for many purposes, such as the clamps illustrated and described in U.S. Patents:

U.S. Pat. No. 195,429 of 1877 concerning Mr. Woodhull's copying-presses;

U.S. Pat. No. 546,903 of 1895, disclosing Mr. Ryan's lineman's vise;

U.S. Pat. No. 1,410,693 of 1992, showing and describing Robert MacDonald's vulcanizer;

U.S. Pat. No. 3,726,466, concerning Messrs. Vedder and Rogers' brazing fixture;

U.S. Pat. No. 4,824,066 of 1989, disclosing Mr. Smith's apparatus for aiding in the storing and preserving of donor corneas; and U.S. Pat. No. 4,978,100 of 1990, illustrating and describing Mr. Peurifoy's fire hose clamp device.

These representative special clamps set forth in patents, and those C clamps, carpenter clamps, and other clamps available currently in the marketplace, are all recognized for their merit. Yet there remained a need for a better performing clamp to be utilized by craft persons who were involved in repairing products, especially snowboards. Often, in repairing wide snowboards, there was a need for tailoring the distribution of the overall clamping force, whereby in a repair volume location, the repairing materials, after their positioning and during their curing, could be adequately contoured and held in positions conforming to the overall contour of the snowboard.

SUMMARY

When a product, such as a snowboard, has been damaged, yet remains repairable by the proper positioning of repairing materials, which are held firmly in their conforming positions, during their curing, to become an integral portion of the product, a clamp is needed to distribute the overall clamping force that is utilized, to insure the integration, binding, and conformation of repairing materials, into the product, within the contour thereof.

This very adequate distribution of such a clamping force is undertaken by using the portable clamp. A preliminary clamping fastener assembly of this portable clamp is conveniently operated to draw together a bottom clamp bar and a top clamp bar, after the portable clamp has been positioned, both over a repair volume location and across the product, such as a snowboard.

Before this preliminary clamping fastener assembly is tightened, and preferably before the clamp bars are positioned, a pressure distribution pressure plate of this portable clamp is located directly over and often extending beyond the repair volume location. Then, after the preliminary clamping fastener assemblies are tightened, final clamping fastener assemblies are tightened to further distribute the overall clamping force to the pressure distribution pressure plate and consequently distribute clamping forces to the curing repairing materials to specifically and accurately conform these materials to the product, and the contour thereof.

The final clamping fastener assemblies are threadably positioned at spaced locations on the top clamp bar, in the central area thereof. They have torque applying arms above and pivotal pressure transferring feet below, which bear against the pressure distribution plate, By the selective tightening of these respective final clamping fastener assemblies, their pressure distribution plate is moved to conform the curing repairing materials in the repair volume location to match the overall contour of the product, such as a snowboard.

DRAWINGS

A preferred embodiment of the portable clamp is illustrated in the drawings, wherein.

Figure 2:
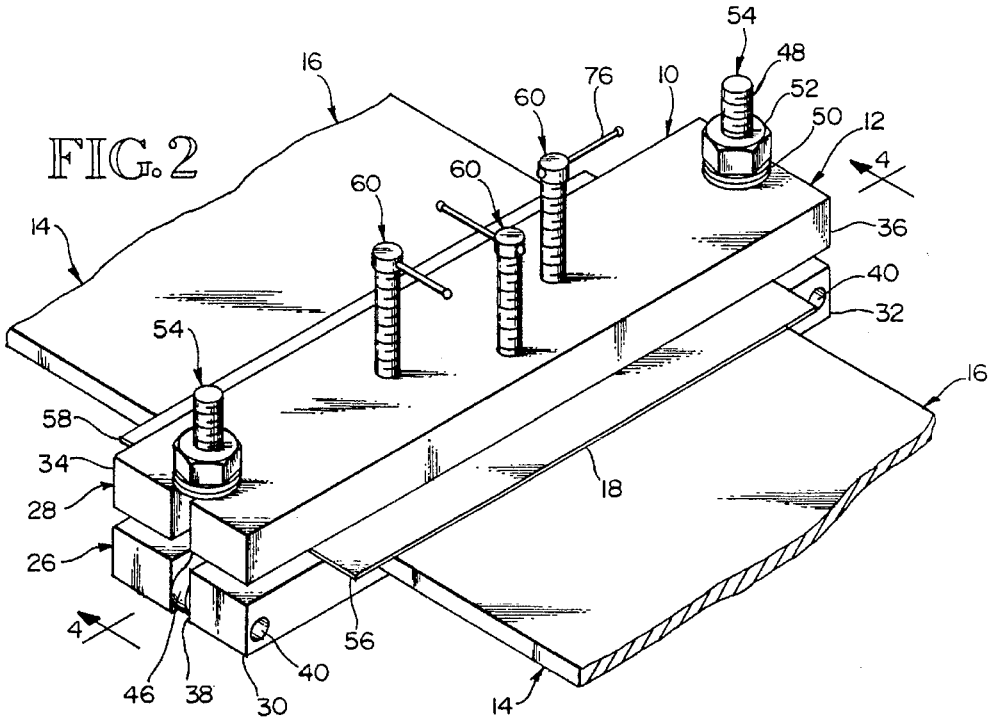
FIG. 2 is an enlarged, partial perspective view showing the portable clamp arranged in the clamping position thereof, when tightened about a product, such as a snowboard, which has a portion thereof undergoing repairs.
Figure 3:
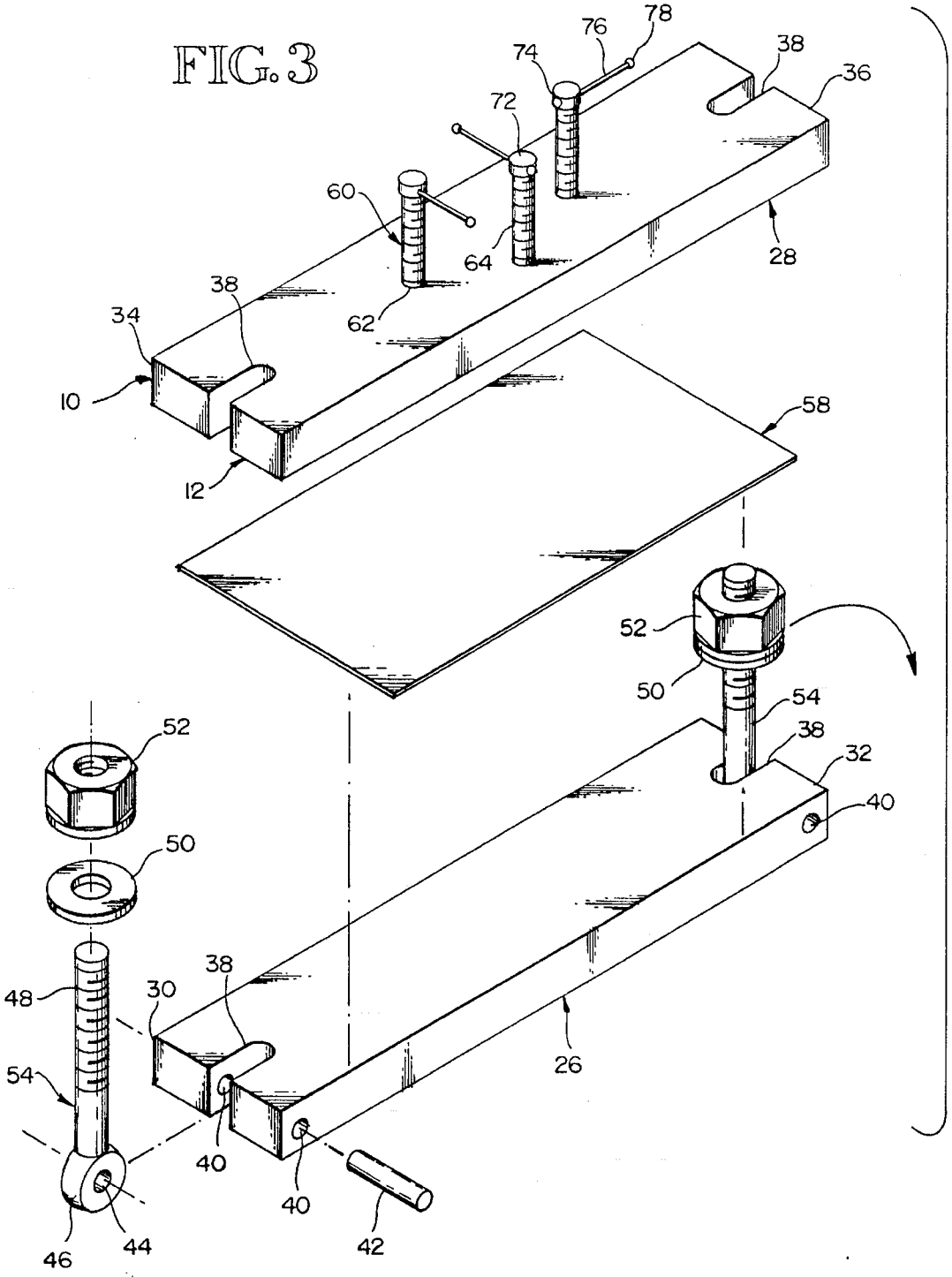
Figure 4:
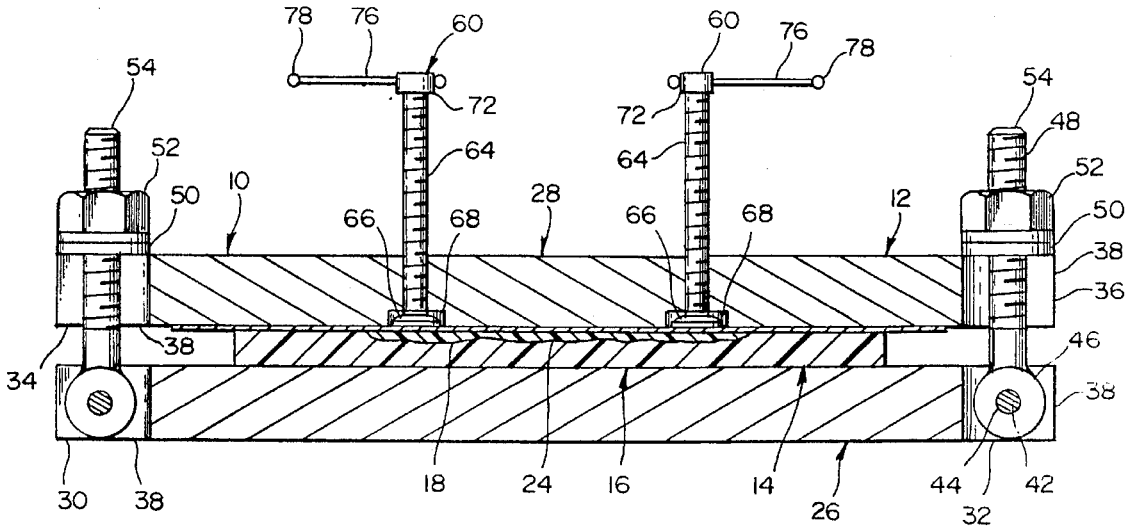

FIG. 3 is an exploded view of the respective portions and components of the portable clamp, before the final assembly thereof; and FIG. 4 is a cross-sectional view, taken along line 4—4 of FIG. 2, illustrating how the portable clamp has been secured in position about the product, such as a snowboard, in the locale where an originally damaged volume of the product has been reworked and filled with repairing materials, which must be firmly compressed into the ultimate repaired position thereof, while the repairing materials are curing.

DESCRIPTION OF THE PREFERRED EMBODIMENT

Figure 1:
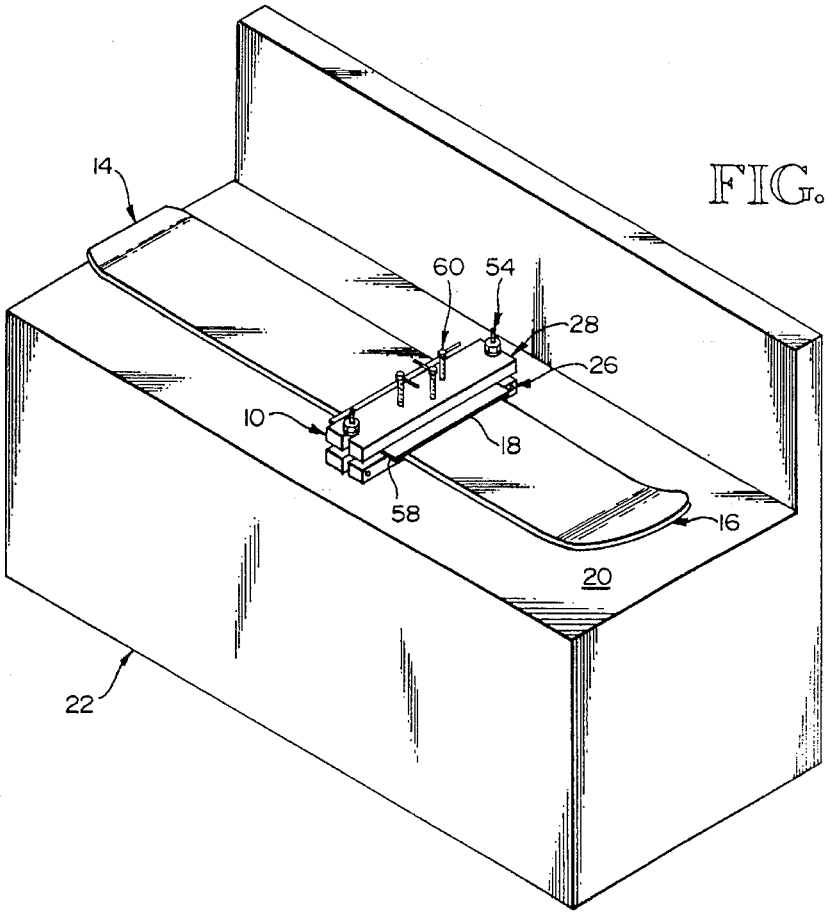
FIG. 1 is a perspective view of a work bench on which a product, such as a snowboard, has been placed so repairs may be undertaken conveniently, and after a damaged volume of the product has been reworked and filled with repairing materials, this portable clamp is positioned transversely about the product to cover the repair volume location.

The portable clamp 10, in respect to a preferred embodiment 12 thereof, is illustrated throughout the drawings, in reference to a product 14, such as a snowboard 16, which has been damaged in at least one repair volume location 18, as shown in FIG. 4. Generally, the product 14 is placed on a top 20 of a work bench 22, to be placed at a convenient working height, as shown in FIG. 1. Thereafter, at the repair volume location 18, the repair person reworks this location 18 to prepare for the entry of repairing materials 24, which are subsequently skillfully arranged within the repair volume location 18. Then, during the curing of these repairing materials 24, this portable clamp 10 is utilized to maintain a compressive force, which is distributed uniformly about and beyond the repair volume location 18.

How this portable clamp 10 is constructed, assembled, and utilized, is observed in all the FIGS. 1 through 4. The construction of this portable clamp 10 is particularly shown in the exploded view of FIG. 3. Both a bottom clamp bar 26 and a top clamp bar 28, of like length, width, thickness, and preferably metal material, have each of their respective ends 30, 32, 34, and 36, formed with like vertical end slots 38.

The vertical end slots 38 in the respective ends 30, 32 of the bottom clamp bar 26, each interrupt respective transverse through receiving passageways 40, which subsequently receive, position, and hold, a respective shaft 42 in a close fit.

Each respective shaft 42 is rotatably received in a through passageway 44 in a ring-like bolt head 46 of a respective threaded bolt 48 during assembly. Each bolt 48 receives a washer 50 and a nut 52 to complete the two respective preliminary clamping fastener assemblies 54.

When each preliminary clamping fastener assembly 54 is rotatably secured about a respective shaft 42, in turn closely fitted in each transverse through receiving passageway 40 in the bottom clamp bar, they are ready for their convenient handling during their in and out placements in the respective aligned vertical slots 38 in the bottom clamp bar 26 and in the top clamp bar 28.

A pressure distribution plate 58 of thinner, preferably 14 metal material, and preferably shorter in length and greater in width than the bottom and top clamp bars 26, 28, is provided for placement over repairing materials during their curing to further distribute the clamping force, and also serve as a replaceable part, if necessary. This plate 58 possibly may be over-stressed and/or covered in part with clinging cured repairing materials, requiring, at least, its temporary prompt replacement during the reconditioning thereof, by substituting a spare one, 58.

When the pressure distribution plate 58 is in place, as shown in FIGS. 1, 2, and 4, and the portable clamp 10 is well positioned about the product 14, such as a snowboard 16, then final clamping fastener assemblies 60 are tightened to further distribute clamping forces to the repairing materials 24 in the repair volume location 18 of the product 14.

The top clamp bar 28 has respective threaded vertical holes 62 to receive the threaded clamping screws 64 of the final clamping fastener assemblies 60. Each of these clamping screws 64, preferably has a pivotally secured pressure transferring foot 66, which upon tightening uniformly contacts the then conforming pressure distribution plate 58. The threaded vertical holes 62 each terminate, at the respective bottoms thereof, in a receiving volume 68 to accommodate the positioning of a respective pressure transferring foot 66.

The respective heads 72 of the threaded clamping screws 64, have a transverse receiving hole 74 to slidably receive a torque applying lever arm 76, in turn having respective enlarged ends 78 to keep the adjustable lever arm 76 in position.

Preferably, as shown in FIGS. 2 and 4, three spaced final clamping fastener assemblies 60 are utilized in the illustrated preferred embodiment 12 of the portable clamp 10, to apply the final selection of compressive forces in the repair volume location 18, to conform the curing repairing materials 24 to the product 14, such as a snowboard 16.

In respect to a specific portable clamp 10, arranged as a preferred embodiment 12 of this portable clamp 10, the bottom and top clamp bars 26, 28 are 13 inches long, 3 inches wide and 1 inch thick. The metal material used is aluminum.

The pressure distribution plate 58 is 11 ½ inches long, 4 inches wide, and 0.063 of an inch thick. The metal material used is stainless steel.

I claim:

1. A portable clamp having cooperating and interfitting members distributing clamping forces during the application of both preliminary clamping forces and final clamping forces, using respectively operated tightening fastener assemblies, with the final clamping forces being distributed through a conforming pressure distribution plate, whereby the portable clamp is particularly functional when repairing, for example, a damaged snowboard, comprising:

a. a bottom clamp bar;

b. a top clamp bar;

c. preliminary clamping fastener assemblies arranged respectively at the respective associated ends of the bottom and top bars, which, when tightened, draw the bottom and top clamp bars together;

d. a pressure distribution plate fitted between the bottom clamp bar and the top clamp bar; and e. final clamping fastener assemblies arranged at spaced locations on the top clamp bar, which, when tightened, move the pressure distribution plate toward the bottom clamp bar;

whereby, when repairs are being made, for example on a snowboard, and after the damaged volume has been reworked and filled with repairing materials, this portable clamp is positioned transversely about the snowboard to cover the repair volume location, with the pressure distribution plate being located directly above the repair volume, and then preliminary clamping fastener assemblies are fully tightened, and thereafter the final clamping fastener assemblies are tightened, keeping the repairing materials in the repair volume firmly in position during the curing of the repairing materials in the repair volume location of the snowboard or other product needing such repair.

2. A portable clamp, as claimed in claim 1, wherein the pressure distribution plate is wider than either the bottom or top clamp bar, thereby extending the effective repair force area created upon the tightening of the final clamping fastener assemblies.

3. A portable clamp, as claimed in claim 1, wherein the preliminary clamping fastener assemblies at one end thereof, are pivotally secured to the bottom clamp bar.

4. A portable clamp, as claimed in claim 1, wherein the final clamping fastener assemblies are threadably positioned, in part of their length in the top clamp bar.

5. A portable clamp, as claimed in claim 4, wherein the final clamping fastener assemblies each have a pivotal secured pressure transferring foot, which upon tightening uniformly contacts the pressure distribution plate.

6. A portable clamp, as claimed in claim 1, wherein the pressure distribution plate during the use of the clamp may become roughened too extensively by clamping forces and/or clinging repairing materials, and therefore another pressure distribution plate is substituted therefor.

7. A portable clamp, as claimed in claim 2, wherein the final clamping fastener assemblies are threadably positioned, in part of their length, in the top clamp bar.

8. A portable clamp, as claimed in claim 7, wherein the final clamping fastener assemblies each have a pivotally secured pressure transferring foot, which upon tightening, uniformly contacts the pressure distribution plate.

9. A portable clamp, as claimed in claim 4, wherein the final clamping fastener assemblies each have a pivotally secured pressure transferring foot, which upon tightening uniformly contacts the pressure distribution plate.

10. A portable clamp, as claimed in claim 8, wherein the preliminary clamping fastener assemblies, at one end thereof, are pivotally secured to the bottom clamp bar.

11. A portable clamp, as claimed in claim 9, wherein the preliminary clamping fastener assemblies, at one end thereof, are pivotally secured to the bottom clamp bar.

12. A portable clamp, as claimed in claim 3, wherein the preliminary clamping fastener assemblies, at one end thereof, are pivotally secured to the bottom clamp bar, by having: respective vertical end slots arranged in the bottom clamp bar and the top clamp bar, and in vertical alignment one with the other of these respective vertical end slots; a transverse through receiving passageway at the respective ends of the bottom clamp bar, which is interrupted by the respective vertical end slot; a respective shaft for a close fit in each transverse through receiving passageway; a respective pivotal bolt having a bolt head, having, in turn, a through passageway for receiving the shaft, before the fitting thereof in the transverse through receiving passageway, upon the assembly of this portable clamp; and a washer and nut for placement over the respective pivotal bolt, at the free end thereof, whereby, when the portable clamp has been positioned on a product, such as a snowboard, the respective preliminary clamping fastener assemblies are pivoted upright within the aligned respective vertical end slots and thereafter tightened to draw the top clamp bar and the bottom clamp bar together, to complete the preliminary clamping.

* * * * *